US005235296A

United States Patent [19]

Saka

[11] Patent Number: 5,235,296

[45] Date of Patent: Aug. 10, 1993

[54] DIRECTIONAL COUPLER USING A MICROSTRIP LINE

[75] Inventor: Hiroshi Saka, Katano, Japan

[73] Assignee: Matsushita Electric Industrial Co., Ltd., Osaka, Japan

[21] Appl. No.: 799,072

[22] Filed: Nov. 27, 1991

[30] Foreign Application Priority Data

Nov. 28, 1990 [JP] Japan ..... 2-332422
Nov. 28, 1990 [JP] Japan ..... 2-332423
Nov. 28, 1990 [JP] Japan ..... 2-332424

[51] Int. Cl.[5] ..... H01P 5/18
[52] U.S. Cl. ..... 333/109; 333/116
[58] Field of Search ..... 333/109, 110, 112, 115, 333/116, 117, 120, 124, 136, 246

[56] References Cited

U.S. PATENT DOCUMENTS 3,772,616 11/1973 Imoto ..... 333/116 X
4,127,831 11/1978 Riblet ..... 333/116 X
4,697,161 9/1987 Buoli ..... 333/116
4,928,078 5/1990 Khandavalli ..... 333/116 X

*Primary Examiner*—Steven Mottola
*Assistant Examiner*—Seung Ham
*Attorney, Agent, or Firm*—Wenderoth, Lind & Ponack

[57] ABSTRACT

In a directional coupler having four input/output terminals in a planar circuit using strip lines or microstrip lines, a quarter-wavelength line is connected between first and third terminals, and between second and fourth terminals, respectively, and furthermore between first and second terminals, and between third and fourth terminals, individually, a branch line is connected, having a length which is (2N+1)/4 wavelength, cascading (2N+1) pieces of quarter-wavelength lines (where N is a positive integer). These (2N+1) quarter-wavelength lines composing the branch lines are set so that lines of high characteristic impedance and lines of low characteristic impedance appear alternately. The (2N+1) quarter-wavelength lines in which the lines of high characteristic impedance and low characteristic impedance appear alternately function equivalently to (2N+1)/4 wavelength lines of a higher characteristic impedance, or equivalently to (2N+1)/4 wavelength lines of a lower characteristic impedance, thereby operating as a directional coupler having a small coupling coefficient or as a directional coupler of having a large coupling coefficient.

10 Claims, 7 Drawing Sheets

DIRECTIONAL COUPLER USING A MICROSTRIP LINE

BACKGROUND OF THE INVENTION

1. Field of the invention

The present invention relates to a directional coupler using a strip line or a microstrip line, in particular using a microstrip line.

2. Description of the Prior Art

FIG. 9 shows a conventional branch-line directional coupler, in which a line 95' of a characteristic impedance $Z_1$ is formed in a line 95 linking a terminal 91 and a terminal 93 over a length of a quarter-wavelength ($\frac{1}{4}\lambda s$: $\lambda s$ is a wavelength on a transmission line of a ratio frequency signal), and a line 96' of the characteristic impedance $Z_1$ is formed in a line 96 linking a terminal 92 and a terminal 94 over a length of a quarter-wavelength ($\frac{1}{4}\lambda s$). On both sides of the quarter-wavelength ($\frac{1}{4}\lambda s$) line 95' of the characteristic impedance $Z_1$, one end of each of two one-quarter-wavelength lines 97 and 98 of a characteristic impedance $Z_2$ are connected at an interval of a quarter-wavelength, and on both sides of the quarter-wavelength line 96' of the characteristic impedance $Z_1$, the other end of each of the two one-quarter-wavelength lines 97 and 98 of the characteristic impedance $Z_2$ are connected at an interval of a quarter-wavelength. The characteristic impedance $Z_1$ of the one-quarter-wavelength lines 95' and 96' is selected to be lower than a characteristic impedance $Z_0$ of the lines 95 and 96 (usually 50Ω), and the characteristic impedance $Z_2$ of the one-quarter-wavelength lines 97 and 98 is selected to be higher than the characteristic impedance $Z_0$ of the lines 95 and 96.

The radio frequency signal entering the terminal 91 may be designed to appear at the terminals 93 and 94, but not at the terminal 92. By adjusting the characteristic impedances $Z_1$ and $Z_2$, the coupling coefficient C between the terminal 91 and the terminal 94 (the ratio of the signal level delivered to the terminal 94 to the signal level entering the terminal 91) is determined.

In this branch-line directional coupler, the isolation between the terminal 91 and the terminal 92 (which is evaluated by the ratio of the signal level delivered to the terminal 92 to the signal level entering the terminal 91, and in which the smaller the ratio, the better the isolation) is excellent.

In this branch-line directional coupler, the coupling coefficient C between the terminal 91 and the terminal 94 was relatively large, and one of smaller coupling coefficient C could not be obtained, which was a disadvantage. For example, FIG. 10 is a characteristic diagram showing the relationship of the characteristic impedance $Z_1$ of the one-quarter-wavelength lines 95' and 96', the characteristic impedance $Z_2$ of the one-quarter-wavelength lines 97 and 98, and the coupling coefficient C between the terminal 91 and the terminal 94 at the center frequency, in the branch-line directional coupler in FIG. 9, and the relationship is as follows.

$$Z_1 = Z_0\sqrt{1-\beta^2}$$

$$Z_2 = Z_0\sqrt{1-\beta^2}/\beta$$

In this case, the coupling coefficient C and the coupling coefficient $\beta$ are satisfying the relationship of $C=20\log\beta$.

When composing a branch-line directional coupler in a microstrip line on a dielectric substrate with a relative dielectric constant of 2.5 and a thickness of 0.6 mm, for example, a PTFE glass cloth substrate, if narrowing the line width W of two one-quarter-wavelength lines 97 and 98, a practical limit is 100 microns, and the characteristic impedance $Z_2$ of the one-quarter-wavelength lines 97 and 98 at this time is about 160Ω, and it was hence difficult to reduce the coupling coefficient C between the terminal 91 and terminal 94 markedly from −10 dB.

Thus, in the prior art described above, although the characteristic of excellent directivity may be easily obtained, it is hard to obtain the characteristic of the small coupling coefficient C of −10 dB or less.

Furthermore, in this branch-line directional coupler, the coupling coefficient C of the terminal 91 and terminal 94 is relatively large, and as approaching −3 dB, the characteristic impedance $Z_2$ of the one-quarter-wavelength lines 97 and 98 which are branch lines comes to be closer to the characteristic impedance $Z_0$, while the line width W of the one-quarter-wavelength lines 97 and 98 approaches the line width $W_0$ of the characteristic impedance $Z_0$. However, when composing a directional coupler in a microstrip line with a coupling coefficient C=−3 dB in a 14 GHz band on a dielectric substrate having a relative dielectric constant of 2.5 and a thickness of 0.6 mm, such as a PTFE glass cloth substrate, the characteristics are $\frac{1}{4}\lambda s=3.5$ mm. $W=W_0=1.7$ mm, and it is not clear from where to where is the actual length of the one-quarter-wavelength lines 95' and 96', or from where to where is the actual length of the one-quarter-wavelength lines 97 and 98, and designing of line patterns of the directional coupler was difficult, and the characteristics exactly as designed could not be obtained.

SUMMARY OF THE INVENTION

It is hence a primary object of the invention to present, in the light of the above problems, a directional coupler capable of eliminating or reducing the demerits of the prior art in a simple configuration, and possessing a relatively small coupling coefficient (−10 dB or less) and excellent characteristics of directivity, and also to present a directional coupler having easy to design line patterns and capable of easily obtaining characteristics exactly as designed.

The directional coupler of the invention possesses first, second, third and fourth input/output terminals, in which the first and third input/output terminals are connected through a first quarter-wavelength line, the second and fourth input/output terminals are connected through a second quarter-wavelength line, the first and second input/output terminals is connected through a third line of (2N+1)/4 wavelength long with (2N+1) one-quarter-wavelength lines cascaded where N is a positive integer, and the third and fourth input/output terminals are connected through a fourth line of (2N+1)/4 wavelength long with (2N+1) one-quarter-wavelength lines cascaded. The characteristic impedance of the first and second one-quarter-wavelength lines is selected to be lower than the characteristic impedance (usually 50Ω) of the transmission line connected to the first, second, third and fourth input/output terminals. The characteristic impedance of the (2N+1) one-quarter-wavelength lines cascaded to compose the third line is selected such that the adjacent one-quarter-wavelength lines are different in characteristic impedance from each other. The characteristic impedance of the (2N+1) one-quarter-wavelength lines cascaded to compose the fourth line is selected such that the adjacent one-quarter-wavelength lines are different in characteristic impedance from each other.

According to the invention, in designing a directional coupler of small coupling coefficient C, by setting the characteristic impedance of the (2N+1) one-quarter-wavelength lines for composing the third and fourth lines of (2N+1)/4 wavelength so that the high impedance and low impedance may alternately appear in this order, it is possible to substantially heighten the characteristic impedance of the third and fourth lines, and a small coupling coefficient C characteristic may be realized. Furthermore, in designing a directional coupler having a relatively large coupling coefficient C, by setting the characteristic impedance of the (2N+1) one-quarter-wavelength lines for composing the third and fourth lines of (2N+1)/4 wavelength so that the low impedance and high impedance alternate in this order, the branch lines, which are one-quarter-wavelength lines positioned at the end of the third and fourth lines, directly connected to the first and second one-quarter-wavelength lines may be realized at a relatively high impedance, and hence in a relatively narrow line width.

The invention brings about the following effects.

(1) In a cascaded composition in a total of (2N+1) pieces of one-quarter-wavelength lines of high impedance and one-quarter-wavelength lines of low impedance, (2N+1)/4 wavelength lines of further higher impedance are composed equivalently, a directional coupler of a smaller coupling coefficient C may be formed easily.

(2) It is not necessary to use a particularly fine line as the line width of the quarter-wavelength line of high impedance, and fluctuations of the coupling coefficient C due to variation of line width in forming line pattern may be lessened.

(3) In the branch line, by using a quarter-wavelength line of a narrow line width, or a quarter-wavelength coupled-line having open-ended structure, a directional coupler of a large coupling coefficient C may be designed, and therefore the actual length of the quarter-wavelength line may be clearer and designing is easy, and characteristics as designed may be easily obtained.

(4) In a configuration using parallel coupled lines, if the propagation velocity is different in the odd mode and even mode of the parallel coupled lines, it is used so as not to directly affect the isolation of the directional coupler, and hence the directional coupler of this embodiment is free from deterioration of isolation due to difference in propagation velocity in the odd mode and even mode, so that the characteristic of excellent directivity (being evaluated by the ratio of the signal level delivered to the fourth terminal to the signal level delivered to the second terminal, where the greater the ratio, the better the directivity) may be maintained. What is more, this directivity is hardly affected by the magnitude of the coupling coefficiency C.

(5) In a configuration using parallel coupled lines, since the parallel coupled lines serve also as the DC block between terminals, it is not necessary to form a new DC block.

(6) In the branch line, by using a quarter-wavelength line or a quarter-wavelength coupled-line having a sufficiently narrow line width as compared with a quarter wavelength, a directional coupler of a large coupling coefficient C may be designed, and deterioration of frequency characteristics due to discontinuity at the connecting point of branch line, quarter-wavelength line and 50Ω transmission line may be lessened, and the characteristics as designed may be easily obtained.

DESCRIPTION OF THE PREFERRED EMBODIMENTS

Figure 1:
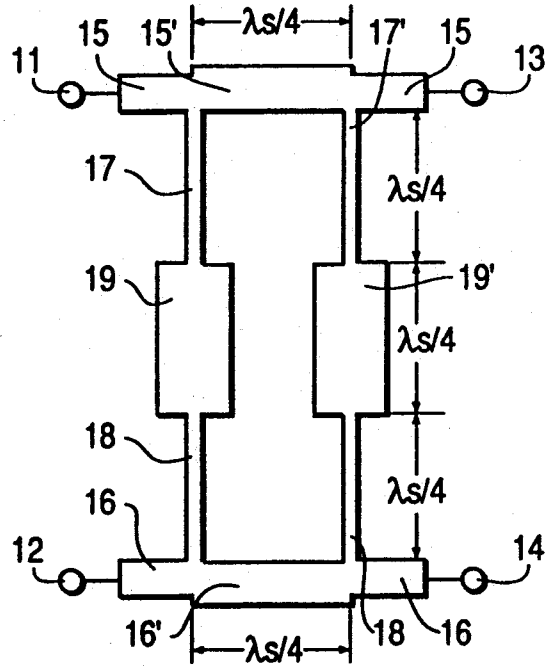
FIG. 1 is a pattern diagram showing a directional coupler in accordance with an embodiment of the present invention.

FIG. 1 relates to a branch-line directional coupler showing an embodiment of the present invention, in which a quarter-wavelength line 15' with characteristic impedance $Z_1$ is formed in a line 15 linking a terminal 11 and a terminal 13 over a length of a quarter wavelength (a quarter of a wavelength on a transmission line of a radio frequency signal, hereinafter expressed as ¼λs). In a line 16 linking a terminal 12 and a terminal 14, a quarter-wavelength line 16' with characteristic impedance $Z_1$ is formed over a length of a quarter-wavelength (¼λs). On both sides of the quarter-wavelength line 15' with characteristic impedance $Z_1$, one-quarter-wavelength lines 17 and 17' with characteristic impedance $Z_2$ are connected at an interval of ¼λs, and on both sides of the quarter-wavelength line 16' with characteristic impedance $Z_1$, one-quarter-wavelength lines 18 and 18' with characteristic impedance $Z_2$ are connected at an interval of ¼λs. The quarter-wavelength line 17 and quarter-wavelength line 18 are connected through a quarter-wavelength line 19 with characteristic impedance $Z_3$, while the quarter-wavelength line 17' and the quarter-wavelength line 18' are connected through a quarter-wavelength line 19' with characteristic impedance $Z_3$. Supposing the terminal 11 to be a signal input port, the terminal 12 is an isolated port and the terminal 14 is a coupling port. The characteristic impedance $Z_1$ of the one-quarter-wavelength lines 15' and 16' is selected to be lower than the characteristic impedance $Z_0$ of the lines 15 and 16, and the characteristic impedance $Z_2$ of the one-quarter-wavelength lines 17, 17', 18 and 18' is selected to be higher than the characteristic impedance $Z_3$ of the one-quarter-wavelength lines 19 19'. At this time, the characteristic impedance $Z_1$ of the one-quarter-wavelength lines 15' and 16', the characteristic impedance $Z_2$ of the one-quarter-wavelength lines 17, 17'. 18, and 18', the characteristic impedance $Z_3$ of the one-quarter-wavelength lines 19 and 19', and the coupling coefficient C between the terminal 11 and terminal 14 are determined so as to satisfy the following relationship at the center frequency.

$$Z_1 = Z_0\sqrt{1-\beta^2} \tag{1-1}$$

$$Zeff = Z_0\sqrt{1-\beta^2}/\beta \tag{1-2}$$

where $Zeff = Z_2^2/Z_3$, and the coupling coefficient C and the coupling coefficient $\beta$ satisfy the relationship of $C = 20 \log \beta$.

Figure 9:
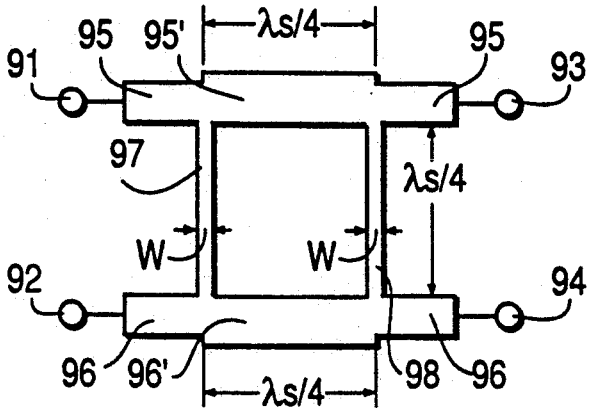
FIG. 9 PRIOR ART
FIG. 9 is a pattern diagram showing a conventional branch-line directional coupler.
Figure 10:
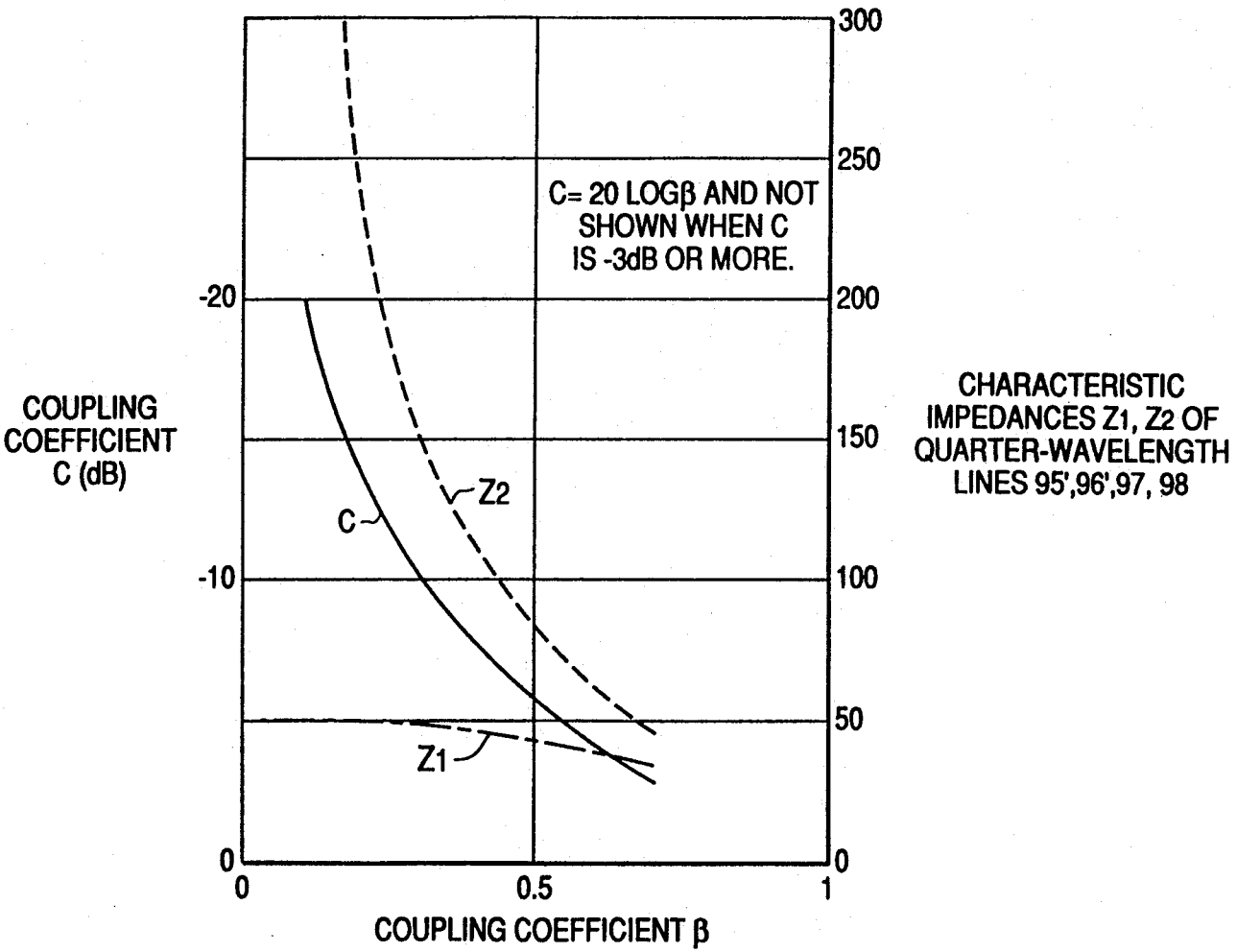
FIG. 10 PRIOR ART
FIG. 10 is a characteristic diagram showing the relationship of the characteristic impedances $Z_1$ and $Z_2$ and coupling coefficient C in the branch-line directional coupler shown in FIG. 9.

In the embodiment in FIG. 1, as the line for linking between the lines 15 and 16, by using a three-quarter-wavelength line cascading three one-quarter-wavelength lines 17, 19, 18 (or three one-quarter-wavelength lines 17', 19', 18'), the characteristic impedance of the line may be raised equivalently, and a small coupling coefficient may be easily realized. For example, the three-quarter-wavelength line cascading three one-quarter-wavelength lines 17, 19, 18 with the characteristic impedance of $Z_2$, $Z_3$, $Z_2$, respectively, is approximated by one three-quarter-wavelength line with the characteristic impedance of Zeff, and is given as $Zeff = Z_2^2/Z_3$. Therefore, by setting as $Z_2 > Z_3$, it is possible to set $Zeff > Z_2$, and the higher characteristic impedance than the characteristic impedance $Z_2$ of the one-quarter-wavelength lines 97 and 98 in the prior art shown in FIG. 9 may be effectively realized. Hence, by adjusting the characteristic impedances $Z_2$, $Z_3$, $Z_2$ of the three one-quarter-wavelength lines 17, 19, 18 (or three one-quarter-wavelength lines 17', 19', 18'), it is possible to easily go from a small coupling coefficient to a large coupling coefficient. The effect is particularly great when using a dielectric substrate with a high relative dielectric constant. Furthermore, when designing one of a small coupling coefficient, it is no longer necessary to extremely narrow the line width of the one-quarter-wavelength lines 17 and 18 (or one-quarter-wavelength lines 17', 18') to set the characteristic impedance higher, and therefore it is also effective to decrease the fluctuations of the coupling coefficient due to variation of the line width when making line patterns.

Figure 2:
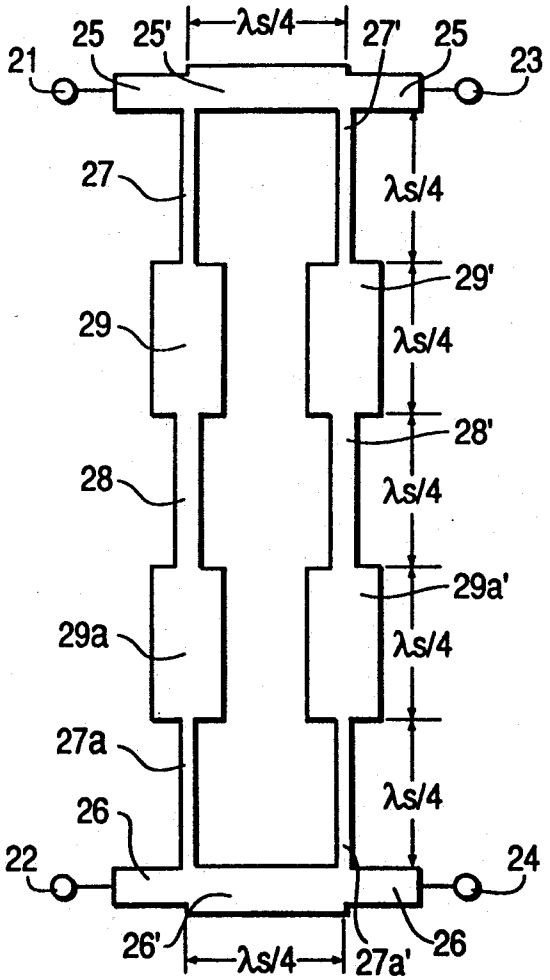
FIG. 2 is a pattern diagram showing a directional coupler in accordance with embodiment of the present invention.

FIG. 2 is a directional coupler showing another embodiment of the present invention, in which a quarter-wavelength line 25' with characteristic impedance $Z_1$ is formed in a line 25 linking a terminal 21 and a terminal 23 over a length of a quarter-wavelength ($\frac{1}{4}\lambda s$). In a line 26 linking a terminal 22 and a terminal 24, a quarter-wavelength line 26' with characteristic impedance $Z_1$ is formed over a length of a quarter-wavelength ($\frac{1}{4}\lambda s$). On both sides of the quarter-wavelength line 25' with characteristic impedance $Z_1$, one quarter-wavelength lines 27 and 27' with characteristic impedance $Z_2$ are connected at an interval of $\frac{1}{4}\lambda s$, and on both sides of the quarter-wavelength line 26' with characteristic impedance $Z_1$, one-quarter-wavelength lines 27a and 27a' with characteristic impedance $Z_2$ are connected at an interval of $\frac{1}{4}\lambda$. The quarter-wavelength line 27 and quarter-wavelength line 27a are connected through a three-quarter-wavelength line cascading a quarter-wavelength line 29 with characteristic impedance $Z_3$, a quarter-wavelength line 28 with characteristic impedance $Z_4$, and a quarter-wavelength line 29a with characteristic impedance $Z_3$, while the quarter-wavelength line 27' and the quarter-wavelength line 27a' are connected through a three-quarter-wavelength line cascading a quarter-wavelength line 29' with characteristic impedance $Z_3$, a quarter-wavelength line 28' with characteristic impedance $Z_4$, and a quarter-wavelength line 29a' with characteristic impedance $Z_3$. The characteristic impedance $Z_1$ of the one-quarter-wavelength lines 25' and 26' is selected to be lower than the characteristic impedance $Z_0$ of the lines 25 and 26, and the characteristic impedance $Z_2$ of the one-quarter-wavelength lines 27, 27', 27a, and 27a' is selected to be higher than the characteristic impedance $Z_3$ of the one-quarter-wavelength lines 29, 29', 29a, and 29a'. At this time, the characteristic impedance $Z_1$ of the one-quarter-wavelength lines 25' and 26', the characteristic impedance $Z_2$ of the one-quarter-wavelength lines 27, 27', 27a, and 27a', the characteristic impedance $Z_3$ of the one-quarter-wavelength lines 29, 29', 29a, and 29a', the charactertis impedance $Z_4$ of the one-quarter-wavelength lines 28 and 28', and the coupling coefficient C between the terminal 21 and the terminal 24 are determined so as to satisfy the following relationship at the center frequency.

$$Z_1 = Z_0\sqrt{1-\beta^2} \tag{2-1}$$

$$Zeff = Z_0\sqrt{1-\beta^2}/\beta \tag{2-2}$$

where $Zeff = Z_4 33\ Z_2^2/Z_3^2$, and the coupling coefficient C and the coupling coefficient $\beta$ satisfy the relationship of $C = 20 \log\beta$.

In the embodiment in FIG. 2, as the line for linking between the lines 25 and 26, by using a five one-quarter-wavelength line cascading five one-quarter-wavelength lines 27, 29, 28, 29a, and 27a (or five one-quarter-wavelength lines 27', 29', 28', 29a', and 27a'), the characteristic impedance of the line may be heightened equivalently, and a small coupling coefficient may be easily realized. For example, the five-quarter-wavelength line cascading five one-quarter-wavelength lines 27, 29, 28, 29a, and 27a with the characteristic impedance $Z_2$, $Z_3$, $Z_4$, $Z_3$, and $Z_2$, respectively, may be approximated by one five-quarter-length line with the characteristic impedance of Zeff, and it is given as $Zeff = Z_4 \times Z_2^2/Z_3^2$. Therefore, by setting as $Z_4 \times Z_2 > Z_3^2$, it is possible to set $Zeff > Z_2$, and the characteristic impedance higher than the characteristic impedance $Z_2$ of the one-quarter-wavelength lines 97 and 98 in the prior art shown in FIG. 9 may be effectively realized. Therefore, by adjusting the characteristic impedance of the five one-quarter-wavelength lines 27, 29, 28, 29a, and 27a (or five one-quarter-wavelength lines 27', 29', 28', 29a', and 27a'), it is easy to go from a small coupling coefficient to a large coupling coefficient. It is particulary effective when using a dielectric substrate with a high relative dielectric constant. Furthermore, when designing one with a small coupling coefficient, it is no longer necessary to set the characteristic impedance higher by extremely narrowing the line width of the one-quarter-wavelength lines 27, 28, and 27a (or one-quarter-wavelength lines 27', 28', and 27a'), so that it is also effective to reduce the fluctuations of the coupling coefficient due to variation of the line width at the time of forming line patterns.

Figure 3:
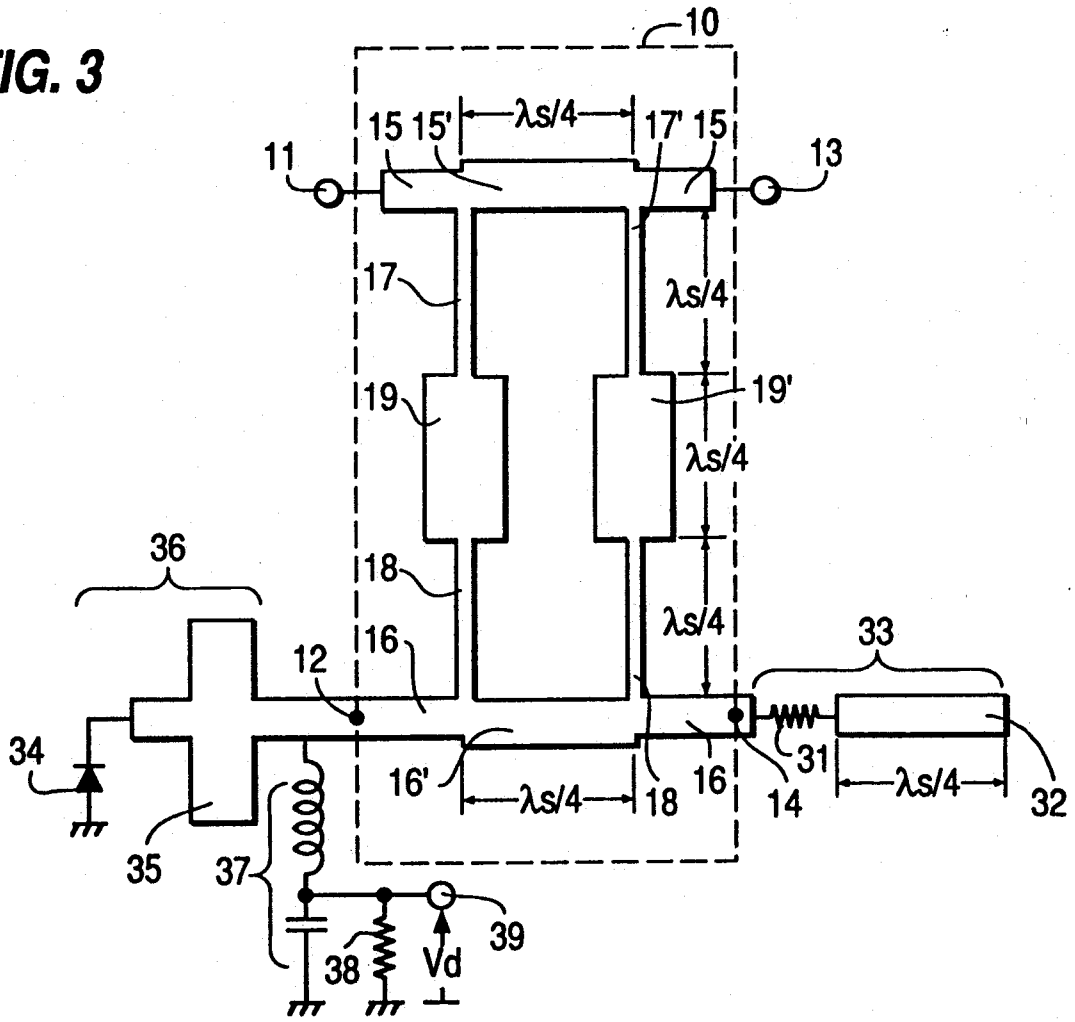
FIG. 3 is a pattern diagram showing a directional coupler in a different embodiment of the present invention.

FIG. 3 shows a directional coupler including a detector circuit in accordance with a different embodiment of the present invention. The parts which are the same as those shown in FIG. 1 are identified by same reference numbers. Numeral 10 is a directional coupler according to the embodiment in FIG. 1, a terminal 13 is a signal input port, and terminal 11 is a signal output port. A terminal 14 is connected to a 50Ω-matched load 33 comprising a dummy resistor 31 and a quarter-wavelength line 32 (length ¼λs) having open-ened structure. A terminal 12 is connected with a detector 36 consisting of a detector diode 34 and an impedance matching circuit 35. Numeral 37 is a choke, 38 is a load resistor, and 39 is a detector voltage output terminal. The signal entering the input port 13 is mostly delivered to the output port 11. However, a part of the input signal (a signal level which is lower by the coupling coefficient C than the input signal level) also appears at the terminal 12, and radio frequency signals are detected by the detector 36, and the detection current corresponding to the signal level appearing at the terminal 12 flows in a diode (for detector) 34. The detection current flows into the load resistor 38, and is detected as detection voltage Vd at the detection voltage output terminal 39.

In the embodiment in FIG. 3, the directional coupler 10 is excellent in isolation between the terminal 11 and terminal 12, and the coupling coefficient C between terminal 13 and terminal 12 is set small. Therefore, it is possible to reduce the deterioration of frequency characteristic of the detection voltage Vd caused by a reflection wave resulted from impedance mismatching in the output port 11.

In the embodiment in FIG. 3, the detector 36 is provided with an impedance matching circuit 35 for raising the detection voltage Vd, but this impedance matching circuit 35 is not particulary needed. In such a case, the detection voltage Vd is lowered, but the frequency characteristic of input reflection loss of the detector 36 is made flat, and the frequency characteristic of the detection voltage Vd is made flat. Furthermore, variations of the input impedance of the detector 36 with respect to changes of input signal level of the terminal 13 becomes smaller, and the linearity of the detection voltage Vd to the input signal level is improved. Still more, the adverse effects by mismatching of the input impedance of the detector 36 may be ignored because the coupling coefficient C of the directional coupler 10 is small and the isolation is favorable.

Figure 4:
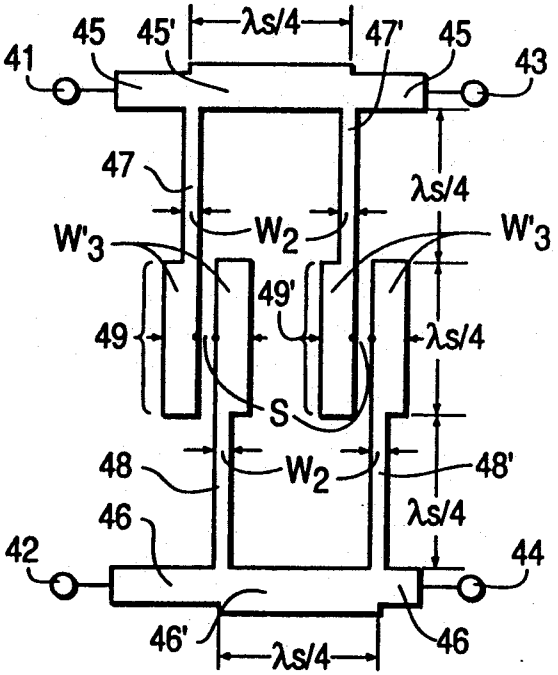
FIG. 4 is a pattern diagram showing a directional coupler in accordance with another different embodiment of the present invention.

FIG. 4 shows a directional coupler in accordance with other embodiment of the present invention, in which a quarter-wavelength line 45' (length ¼λs: λ is a wavelength on a transmission line) with characteristic impedance $Z_1$ is formed in a line 45 linking a terminal 41 and a terminal 43. In a line 46 linking a terminal 42 and a terminal 44, a quarter-wavelength line 46' with characteristic impedance $Z_1$ is formed. On both sides of the quarter-wavelength 45' with characteristic impedance $Z_1$, one-quarter-wavelength lines 47 and 47' with characteristic impedance $Z_2$ (line width $W_2$) are connected at an interval of ¼λs, and on both sides of the quarter-wavelength line 46' with characteristic impedance $Z_1$, one-quarter-wavelength lines 48 and 48' with characteristic impedance $Z_2$ (line width $W_2$) are connected at an interval of ¼λs. The quarter-wavelength line 47 and the quarter-wavelength line 48 are connected through a quarter-wavelength coupled-line having open-ended structure 49 with characteristic impedance $Z_3$ (line width $W_3'$, line interval S), and the quarter-wavelength line 47' and the quarter-wavelength line 48' are connected through a quarter-wavelength coupled-line having open-ened structure 49' with characteristic impedance $Z_3$ (line width $W_3'$, line interval S). Supposing the terminal 41 to be a signal input port, the terminal 42 is an isolated port, and the terminal 44 is a coupling port. The characteristic impedance $Z_1$ of the one-quarter-wavelength lines 45' and 46' is selected to be lower than the characteristic impedance $Z_0$ of the lines 45, and 46, while the characteristic impedance $Z_2$ of the one-quarter-wavelength lines 47, 47', 48, and 48' is selected to be higher than the characteristic impedance $Z_3$ of the quarter-wavelength coupled-lines having open-ended structure 49 and 49', as well as the characteristic impedance $Z_0$ of the lines 45, and 46. At this time, the characteristic impedance $Z_1$ of the one-quarter-wavelength lines 45' and 46', the characteristic impedance $Z_2$ of the one-quarter-wavelength lines 47, 47', 48, and 48', the characteristic impedance $Z_3$ of the quarter-wavelength coupled-lines having open-end structure 49 and 49', and the coupling coefficient C between the terminal 41 and terminal 44 are set so as to satisfy the following relationship at the center frequency.

$$Z_1 = Z_0\sqrt{1-\beta^2} \tag{4-1}$$

$$Zeff = Z_0\sqrt{1-\beta^2}/\beta \tag{4-2}$$

However, in the condition of $Zeff = Z_2^2/Z_3$, the characteristic impedance $Z_3$ of the quarter-wavelength coupled-lines having open-ended structure 49 and 49', the evenmode characteristic impedance Zeven of the parallel coupled lines, and the odd-mode characteristic impedance Zodd satisfy the relationship of $Z_3 = (Zeven - Zodd)/2$, and the coupling coefficient C and the coupling coefficient $\beta$ satisfy the relation of $C = 20 \log \beta$.

In the embodiment shown in FIG. 4, quarter-wavelength coupled-lines having open-ended structure which are transmission lines coupled distributedly are present at two positions, 49 and 49'. Therefore, the radio frequency entering the terminal 41 is delivered to the terminal 42 as a signal A reaching the terminal 42 through the quarter-wavelength coupled-line having open-ended structure 49, and a signal B reaching the terminal 42 through the quarter-wavelength coupled-line having open-ended structure 49', but since both signal A and signal B pass through the quarter-wavelength coupled-lines having identical structure, if there is a difference in the propagation velocity due to odd mode and even mode in the quarter-wavelength coupled-lines, the phase difference of the signal A and signal B is determined by the quarter-wavelength line 45' and the quarter-wavelength line 46', and the quarter-wavelength coupled-lines having open-ended structure 49 and 49' do not affect the isolation of the directional coupler directly. That is, in the directional coupler of the embodiment, deterioration of isolation due to difference in the propagation velocity in the odd mode and even mode does not occur, and the isolation and excellent directivity are maintained. What is more, this directivity is hardly related with the size of the coupling coefficient C. Besides, as the line for linking the lines 45 and 46, by using the three-quarter-wavelength line cascading two one-quarter-wavelength lines 47 and 48 relatively high in characteristic impedance (or two one-quarter-wavelength lines 47' and 48') and one quarter-wavelength coupled-line having open-ended structure 49 relatively low in the characteristic impedance (or the quarter-wavelength coupled-line having open-ended structure 49'), a line sufficiently high in characteristic impedance equivalently (the line length being three-quarter wavelength) may be realized, and the small coupling coefficient C may be easily realized. For example, the three-quarter-wavelength line sequentially cascading the quarter-wavelength line 47 with characteristic impedance $Z_2$, the quarter-wavelength coupled-line having open-ended structure 49 with characteristic impedance $Z_3$, and the quarter-wavelength line 48 with characteristic impedance $Z_2$ may be approximated by one three-quarter-wavelength line with characteristic impedance Zeff, being given as $Zeff=Z_2^2/Z_3$. However, supposing the even-mode characteristic impedance of the quarter-wavelength coupled-line having open-ended structure 49 to be Zeven, and the odd-mode characteristic impedance to be Zodd, it is known that $Z_3=(Zeven-Zodd)/2$. Hence, by setting $Z_2>Z_3$, it is possible to set $Zeff>Z_2$, so that a characteristic impedance higher than the characteristic impedance $Z_2$ of the conventional one-quarter-wavelength lines 97 and 98 in FIG. 9 may be effectively realized. Still more, in the coupled lines, without having to extremely widen the line width as in a single line, a sufficiently low characteristic impedance may be easily realized, so that it is possible to set as $Z_2/Z_3>>1$. Therefore, by adjusting the characteristic impedance $Z_2$ of the two one-quarter-wavelength lines 47 and 48 (or two one-quarter-wavelength lines 47' and 48'), and the characteristic impedance $Z_3$ of the quarter-wavelength coupled-line having open-ended structure 49, the coupling coefficient may be easily realized in a wide range, from small to large coupling coefficient. For example, when composing a directional coupler in a microstrip line on a dielectric substrate with a relative dielectric constant of 2.5 and a thickness of 0.6 mm, the coupling coefficient may be realized in a range from −10 dB to −40 dB, and by selecting at $W_2=1.2$ mm, $W_3'=0.8$ mm, and $S=0.15$ mm, it follows that $Z_2=62\Omega$, $Zeven=99\Omega$, $Zodd=50\Omega$, $Z_3=25\Omega$, and $Zeff=154\Omega$, so that $C=-10$ dB is obtained. If selecting at $W_2=100$ microns, $W_3'=1.5$ mm, and $S=0.8$ mm, it follows that $Z_2=164\Omega$, $Zeven=60\Omega$, $Zodd=48\Omega$, $Z_3=6\Omega$, $Zeff=4700\Omega$, so that $C=-40$ dB is obtained. All dimensions are selected in a realistic and practical range. When using a dielectric substrate of a particularly high relative dielectric constant, it is difficult to realize a line high in characteristic impedance, and the effect of equivalently enhancing the impedance of the line by using three one-quarter-wavelength lines is significant.

Furthermore, when designing one with a small coupling coefficient, it is not necessary to set the characteristic impedance high by extremely narrowing the line width $W_2$ of the one-quarter-wavelength lines 47 and 48 (or one-quarter-wavelength lines 47' and 48'), and therefore it is also effective to reduce the fluctuations of the coupling coefficient due to variation of the line width (especially the narrow line width $W_2$) when forming line patterns.

Figure 5:
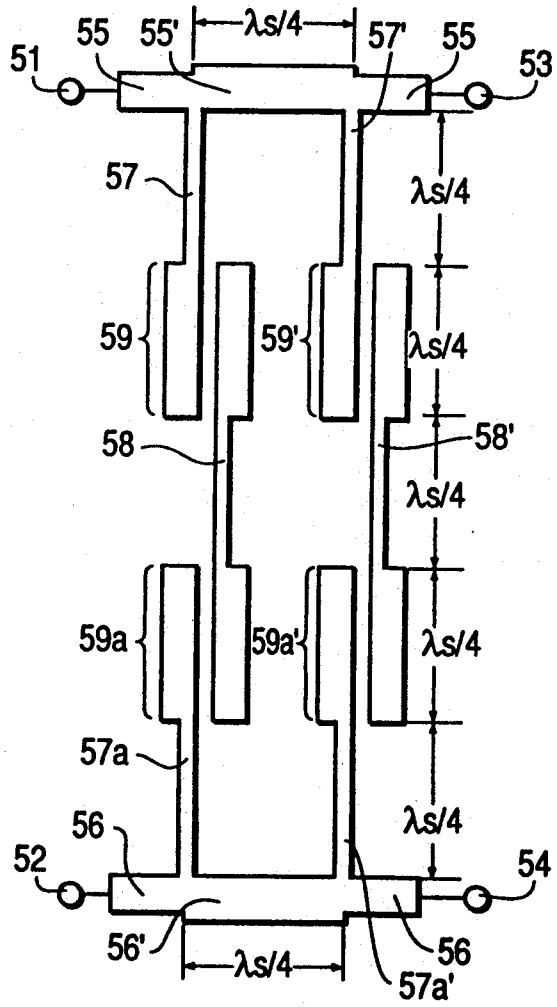
FIG. 5 is a pattern diagram showing a directional coupler in a further different embodiment of the present invention.

FIG. 5 shows a directional coupler in accordance with a further different embodiment of the present invention, in which a quarter-wavelength line 55' (length $\frac{1}{4}\lambda s$) with characteristic impedance $Z_1$ is formed in a line 55 linking a terminal 51 and a terminal 53. A quarter-wavelength line 56' with characteristic impedance $Z_1$ is formed in a line 56 linking a terminal 52 and a terminal 54. On both sides of the quarter-wavelength line 55' with characteristic impedance $Z_1$, one-quarter-wavelength lines 57 and 57' with characteristic impedance $Z_2$ are connected at an interval of $\frac{1}{4}\lambda s$, and on both sides of the quarter-wavelength line 56' with characteristic impedance $Z_1$, one-quarter-wavelength lines **57*a* and 57*a'* with characteristic impedance $Z_2$ are connected at an interval of $\frac{1}{4}\lambda s$. The quarter-wavelength line 57 and the quarter-wavelength line 57*a* are connected through a three-quarter-wavelength line cascading a quarter-wavelength coupled-line having open ended-structure 59 with characteristic impedance $Z_3$, a quarter-wavelength line 58 with characteristic impedance $Z_4$, and a quarter-wavelength coupled-line having open-ended structure 59*a* with characteristic impedance $Z_3$, and the quarter-wavelength line 57' and the quarter-wavelength line 57*a'* are connected through a three-quarter-wavelength line cascading a quarter-wavelength coupled-line having open-ended structure 59' with characteristic impedance $Z_3$, a quarter-wavelength line 58' with characteristic impedance $Z_4$, and a quarter-wavelength coupled-line having open-ended structure 59*a'* with characteristic impedance $Z_3$. Supposing the terminal 51 to be a signal input port, the terminal 52 is an isolated port, and the terminal 54 is a coupling port. The characteristic impedance $Z_1$ of the quarter-wavelength lines 55 and 56' is selected lower than the characteristic impedance $Z_0$ of the lines 55 and 56, while the characteristic impedance $Z_2$ of the quarter-wavelength lines 57, 57', 57*a*, and 57*a'* is selected to be higher than the characteristic impedance $Z_3$ of the quarter-wavelength coupled-lines 59, 59', 59*a*, and 59*a'*. At this time, the characteristic impedance $Z_1$ of one-quarter-wavelength lines 55 and 56', the characteristic impedance $Z_2$ of one-quarter-wavelength lines 57, 57', 57*a*, and 57*a'*, the characteristic impedance $Z_3$ of quarter-wavelength coupled lines 59, 59' 59*a*, and 59*a'*, the characteristic impedance $Z_4$ of one-quarter-wavelength lines 58 and 58', and the coupling coefficient C between the terminal 51 and terminal 54** are set so as to satisfy the following relationship at the center frequency.

$$Z_1 = Z_0\sqrt{1-\beta^2} \tag{5-1}$$

$$Zeff = Z_0\sqrt{1-\beta^2}/\beta \tag{5-2}$$

where Zeff is $Z_4\times Z_2^2/Z_3^2$, and the characteristic impedance $Z_3$ of quarter-wavelength coupled lines having open-ended structure 59, 59', **59*a*, and 59*a'***, the even-mode characteristic impedance Zeven of the coupled lines, and the odd-mode characteristic impedance Zodd satisfy the relationship of $Z_3=(Zeven-Zodd)/2$, and the coupling coefficient C and the coupling coefficient $\beta$ satisfy the relation of $C=20\log\beta$.

In the embodiment shown in FIG. 5, the quarter-wavelength coupled-lines having open-ended structure which are transmission lines coupled distributedly are present at four positions, that is, 59, 59*a*, 59', and 59*a*'. Therefore, the radio frequency signal entering the terminal 51 is delivered to the terminal 52 as a signal A reaching the terminal 52 through two quarter-wavelength coupled lines having open-ended structure 59, 59*a*, and a signal B reaching the terminal 52 through two quarter-wavelength coupled-lines having open-ended structure 59' and 59*a*', but since both signal A and signal B pass through the quarter-wavelength coupled lines having open-ended structure with identical composition, if there is difference in propagation velocity due to odd mode and even mode, the phase difference of signal A and signal B is determined by the lines 55' and 56', and the lines 59, 59*a*, 59' and 59*a*' do not directly affect the isolation of the directional coupler. That is, in the directional coupler of the embodiment, without causing deterioration of isolation due to difference in the propagation velocity of odd mode and even mode, the isolation and excellent directivity are maintained. What is more, this directivity is almost indifferent to the magnitude of the coupling coefficient C. Moreover, as the line for linking the lines 55 and 56, by using a five-quarter-wavelength line cascading the three lines 57, 58, and 57*a* (or three lines 57', 58', and 57*a*'), and two lines 59 and 59*a* (or two lines 59' and 59*a*'), a line of high characteristic impedance (the line length is five-quarter wavelength) is realized eqivalently, so that a small coupling coefficient may be easily obtained. For example, the five-quarter-wavelength line cascading the lines 57, 59, 58, 59*a*, and 57*a* with the characteristic impedances of $Z_2$, $Z_3$, $Z_4$, $Z_3$, and $Z_2$, respectively, may be approximated by one five-quarter-wavelength line with the characteristic impedance of Zeff, and it is given as $Zeff=Z_4\times Z_2^2/Z_3^2$. Therefore, by selecting $Z_2$ and $Z_4$ to be large and $Z_3$ to be small to set as $Z_4\times Z_2>Z_3^2$, it is possible to set as $Zeff>Z_2$, and the characteristic impedance much higher than the characteristic impedance $Z_2$ of the lines 97 and 98 in the prior art in FIG. 9 may be realized effectively. Therefore, by adjusting the characteristic impedance $Z_2$, $Z_4$, and $Z_3$ of the lines 57, 58, 57*a*, 59, and 59*a* (or the lines 57', 58', 57*a*', 59', and 59*a*'), the coupling coefficient may be widely and easily varied from a small coupling coefficient to a large coupling coefficient. In particular, when using a dielectric substrate with a high relative dielectric constant, it is hard to realize a line of high characteristic impedance, and the effect of equivalently heightening the impedance of the line by using a five-quarter-wavelength line is great. Furthermore, when designing one with a small coupling coefficient, it is not necessary to set the characteristic impedance high by extremely narrowing the line width of the lines 57, 58, and 57*a* (or the lines 57', 58', and 57*a*'), and therefore it is also effective to reduce the fluctuations of coupling coefficient due to variation of line width when forming line patterns.

Figure 6:
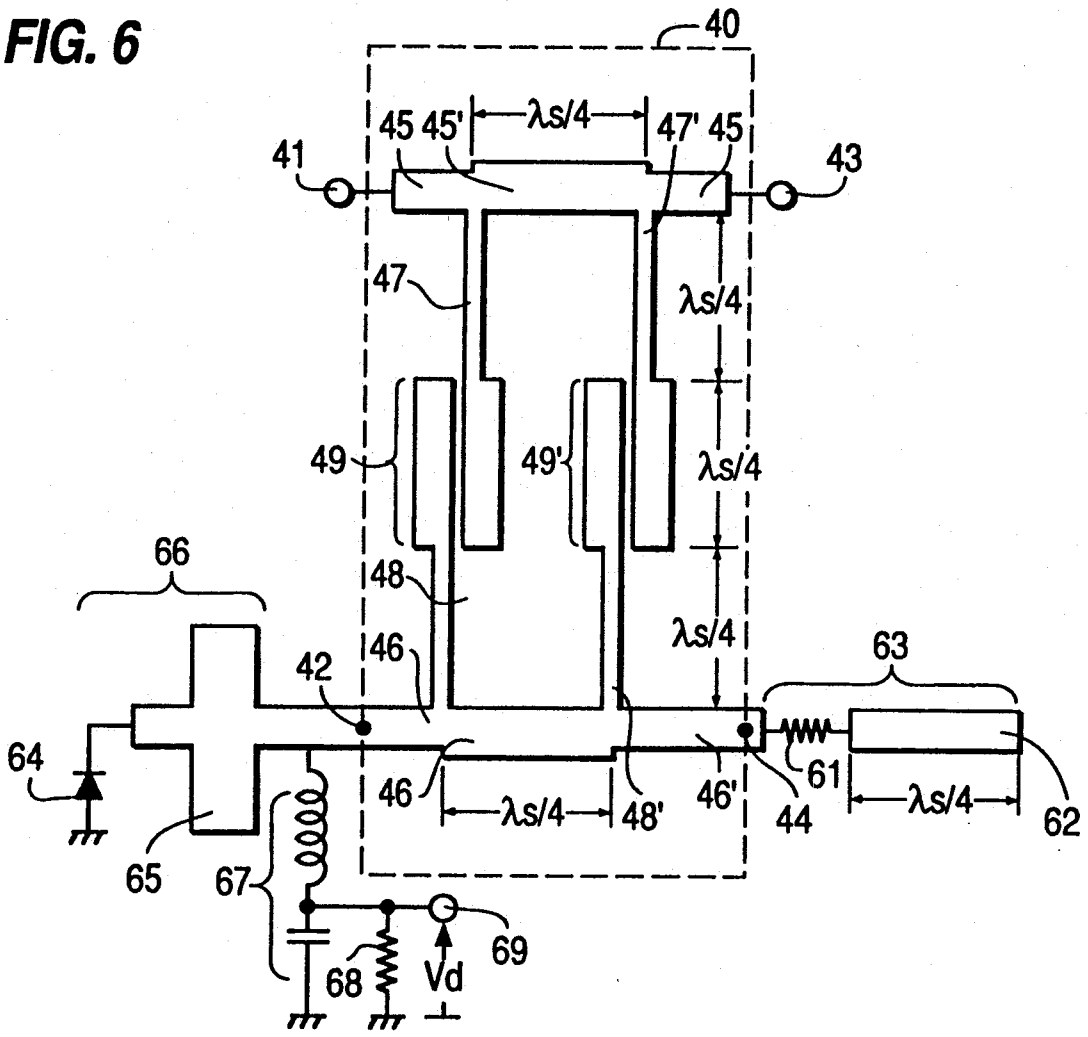
FIG. 6 is a pattern diagram showing a directional coupler in another different embodiment of the present invention.

FIG. 6 shows a directional coupler including a detector showing another embodiment of the present invention, in which those parts which are the same as those parts shown in FIG. 4 are identified by the same reference numbers. Numeral 40 denotes a directional coupler according to the embodiment in FIG. 4, and a terminal 43 is a signal input port and a terminal 41 is a signal output port. The terminal 44 is connected to a 50Ω-matched load consisting of a dummy resistor 61 and a quarter-wavelength line 62 (length ¼λs) having open-ended structure. The terminal 42 is connected to a detector 66 composed of a detector diode 64 and an impedance matching circuit 65. Numeral 67 is a choke, 68 is a load resister, and 69 is a detection voltage output terminal. The signal entering the input terminal 43 is mostly delivered to the output terminal 41. However, a part of the input signal (a signal level which is lower than the input signal level by the coupling coefficient C) also appears at the terminal 42, and the radio frequency signal is detected by the detector 66, and the detection current corresponding to the level of the signal passing through the terminal 42 flows in the diode 64. This detection current is converted into a detection voltage by the load resistor 68, and is detected as the detection voltage Vd at the detection voltage output terminal 69.

In the embodiment in FIG. 6, the directional coupler 40 has excellent isolation between the terminal 41 and terminal 42, and the coupling coefficient between the terminal 43 and terminal 42 is set to be small. Therefore, the deterioration of the frequency characteristic of the detection voltage Vd caused by reflection waves due to impedance mismatching of the output circuit connected to the output terminal 41 may be decreased.

Furthermore, due to the quarter-wavelength coupled-lines 49 and 49', the terminals 41 and 43, and the terminals 42 and 44 are separated in terms of DC, so that it is not necessary to newly install a circuit for DC isolation between the circuit connected to the terminals 41 and 43 and the detector 66.

In the embodiment in FIG. 6, the impedance matching circuit 65 is provided in the detector 66 in order to heighten the detection voltage, but this impedance matching circuit 65 is not particularly necessary.

In such a case, the detection voltage Vd is lowered, but the frequency characteristic of the input reflection loss of the detector 66 becomes flat, and the frequency characteristic of the detection voltage Vd is made flat. Furthermore, the variations of the input impedance of the detector 66 due to input signal level changes of the terminal 43 become small, so that the linearity of the detection level Vd to the input signal level is improved. In addition, adverse effects due to mismatching of the input impedance of the detector 66 may be ignored because the coupling coefficient C of the directional coupler 40 is small and the isolation is excellent.

Figure 7:
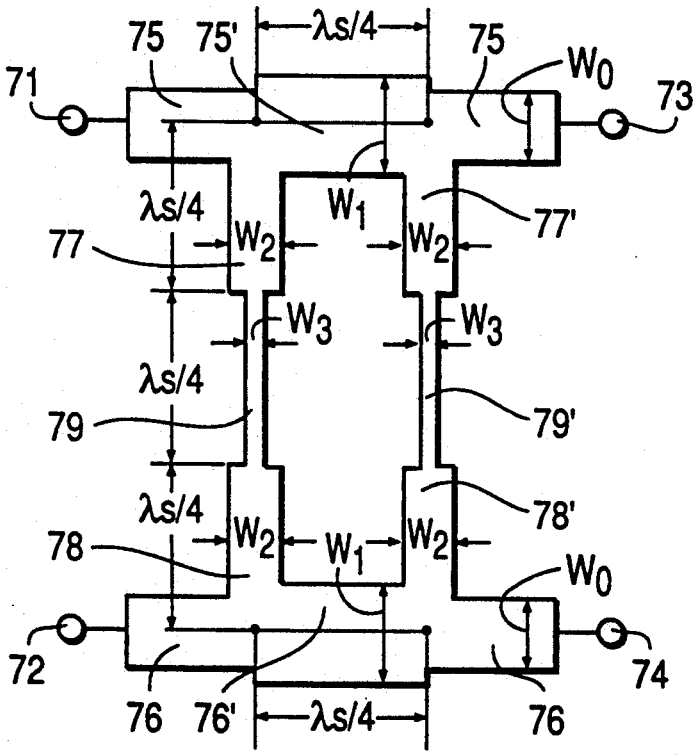
FIG. 7 is a pattern diagram showing a directional coupler in still accordance with embodiment of the present invention.

FIG. 7 shows a directional coupler in accordance with another different embodiment of the invention, in which a quarter-wavelength line 75' (¼λs) with characteristic impedance $Z_1$ is formed in a line 75 connecting a terminal 71 and a terminal 73. In a line 76 linking a terminal 72 and a terminal 74, a quarter-wavelength line 76' (¼λs) with characteristic impedance $Z_1$ is formed.On both sides of the line 75' with $Z_1$, one-quarter-wavelength lines 77 and 77' with characteristic impedance $Z_2$ are connected at an interval of a quarter wavelength so as to branch off, and on both sides of the line 76' with $Z_1$, one-quarter-wavelength lines 78 and 78' with $Z_2$ are connected at an interval of a quarter-wavelength so as to branch off. The line 77 and the line 78 are connected through a quarter-wavelength line 79 with characteristic impedance $Z_3$, and the line 77' and the line 78' are connected through a quarter-wavelength line 79' with $Z_3$. Supposing the terminal 71 to be a signal input port, the terminal 72 is an isolated port, and the terminal 74 is a coupling port. The $Z_1$ of the lines 75' and 76' is selected to be lower than the $Z_0$ of the lines 75 and 76, and the $Z_2$ of the lines 77, 77', 78, and 78' is selected to be higher than the $Z_0$ of the lines 75 and 76 (usually 50Ω), and the $Z_3$ of the lines 79, 79' is selected to be higher than the $Z_2$ of the lines 77, 77', 78, and 78'. At this time, the $Z_1$ of the lines 75 and 76', the $Z_2$ of the lines 77, 77', 78, and 78', the $Z_3$ of the lines 79 and 79', and the coupling coefficient C of the terminal 71 and terminal 74 are set so as to satisfy the following relationship at the center frequency.

$$Z_1 = Z_0\sqrt{1-\beta^2} \tag{7-1}$$

$$Zeff = Z_0\sqrt{1-\beta^2}/\beta \tag{7-2}$$

where Zeff is $Z_2^2/Z_3$, and the coupling coefficient C and the coupling coefficient $\beta$ satisfy the relationship of $C=20\log\beta$. When the coupling coefficient C is −3 dB, the coupling coefficient $\beta$ is $1/\sqrt{2}$, $Z_1=Z_0/\sqrt{2}$, and Zeff is $Z_0$.

In the embodiment in FIG. 7, considering the case of a coupling coefficient C=−3 dB, by setting the $Z_3$ of the lines 79 and 79' higher, according to the formula $Z_2=\sqrt{Z_0\times Z_3}$, the $Z_2$ of the lines 77, 77', 78, and 78' may be also set higher. That is, the line width $W_2$ of the lines 77, 77', 78, and 78' may be narrowed. For example, on a dielectric substrate of PTFE glass cloth with a relative dielectric constant of 2.5 and a thickness of 0.6 mm, the $Z_3$ of the lines 79, and 79' is about 160Ω, assuming that the practical limit of the line width $W_3$ of the lines 79 and 79' is 100 microns. Since $Z_2=\sqrt{Z_0\times Z_3}$= about 90Ω, the line width $W_2$ of the lines 77, 77', 78, and 78' is about 0.6 mm, and this line width is very narrow as compared with the line width W of about 1.7 mm in the prior art shown in FIG. 9. That is, with the quarter-wavelength line of a narrower line width, a directional coupler with a greater coupling coefficient C may be designed, and since the deterioration of the frequency characteristics due to the discontinuity at the connecting points of the branch lines is lessened, designing is easy, and the characteristics may be obtained exactly as designed.

Figure 8:
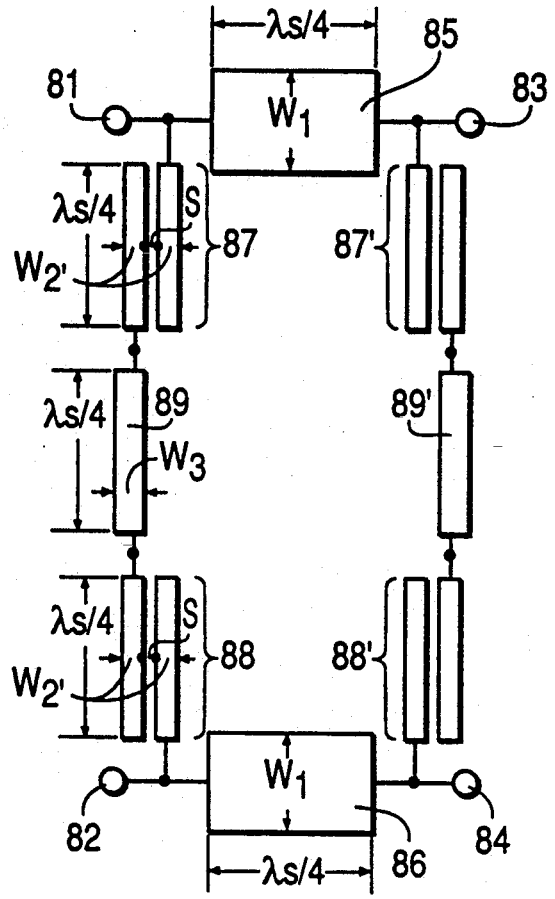
FIG. 8 is a pattern diagram showing a direction coupler in accordance with still a further embodiment of the present invention.

FIG. 8 shows a directional coupler in accordance with a different embodiment of the invention, in which a quarter-wavelength line 85 (¼λs) with characteristic impedance $Z_1$ is connected between a terminal 81 and a terminal 83, and a quarter-wavelength line 86 with $Z_1$ is connected between a terminal 82 and a terminal 84. On both sides of the lines 85 with $Z_1$, quarter-wavelength coupled-lines 87 and 87' having open-ended structure with $Z_2$ are connected at an interval of a quarter-wavelength so as to branch off, and on both sides of the line 86 with $Z_1$, quarter-wavelength coupled-lines 88 and 88' having open-ended structure with $Z_2$ are connected at an interval of a quarter-wavelength so as to branch off. The line 87 and the line 88 are connected through a quarter-wavelength line 89 with $Z_3$, and the line 87' and the line 88' are connected through a quarter-wavelength line 89' with $Z_3$. Assuming that the terminal 81 to be a signal input port, the terminal 82 is an isolated port, and the terminal 84 is a coupling port. The $Z_1$ of the lines 85 and 86 is selected to be lower than the $Z_0$ (usually 50Ω) of the line (line width $W_0$) connected to the terminals 81, 82, 83, and 84. At this time, the $Z_1$ of the lines 85 and 86, the $Z_2$ of the lines 87, 87', 88, and 88', the $Z_3$ of the lines 89 and 89', and the coupling coefficient C between the terminal 81 and the terminal 84 are set so as to satisfy the following relationship at the center frequency.

$$Z_1 = Z_0\sqrt{1-\beta^2} \tag{8-1}$$

$$Zeff = Z_0\sqrt{1-\beta^2}/\beta \tag{8-2}$$

where Zeff is $Z_2^2/Z_3$, and the $Z_2$ of the lines 87, 87', 88, and 88', the even-mode characteristic impedance Zeven of the coupled lines, and the odd-mode characteristic impedance Zodd satisfy the relationship of $Z_2=(Zeven=Zodd)/2$, and the coupling coefficient C and the coupling coefficient $\beta$ satisfy the relationship of $C=20\log\beta$. At the coupling coefficient C=−3 dB, the coupling coefficient $\beta=1/\sqrt{2}$, $Z_1=Z_0/\sqrt{2}$, $Zeff=Z_0$ are given.

In the embodiment in FIG. 8, considering the case of a coupling coefficient C=−3 dB, the $Z_2$ and $Z_3$ satisfy the relationship of $Z_2=\sqrt{Z_0\times Z_3}$, and it is enough to determine by considering the practical range of $Z_2$ and $Z_3$. For example, if the relative dielectric constant of the dielectric substrate is 2.5 and its thickness is 0.6 mm, when selecting in the conditions of line width $W_2'=0.2$ mm, line interval S=0.2 mm, it follows that Zeven=-about 179Ω, and Zodd=about 79Ω, so that $Z_2=(Zeven-Zodd)/2$=about 50Ω may be obtained. Assuming that the practical range of the $Z_2$ is $W_2'=100$ microns or more and S=100 microns or more, $Z_2$ is 80 to 90Ω or less, and the $Z_3$ at this time is 100Ω or less, and this value is within the practical range, too. In this way, using coupled lines (line width $W_2'$, line interval S), the line width $W_2'$ may be narrowed, and therefore, using coupled lines of narrow line width, a directional coupler with a large coupling coefficient C may be designed, and as deterioration of frequency characteristics due to discontinuity at the connecting point of branch lines is lessened, designing is easy, and the characteristics may be easily obtained exactly as designed. Furthermore, the quarter-wavelength coupled-lines act as the DC blocking circuit, so that isolated port and coupling port may be separated from input port and output port in terms of DC.

What is claimed is:

1. A directional coupler comprising:

first, second, third and fourth input/output terminals, each having transmission lines respectively connected thereto;

a first line having a line length which is a quarter-wavelength, said first line being connected between the transmission lines associated with said first and third input/output terminals;

a second line having a line length which is a quarter-wavelength, said second line being connected between the transmission lines associated with said second and fourth input/output terminals;

a third line having a line length which is (2N+1)/4 wavelength wherein N is a positive integer, said third line comprising cascaded (2N+1) one-quarter-wavelength lines, connected between the transmission lines associated with said first and second input/output terminals; and a fourth line having a line length which is (2N+1)/4 wavelength, said fourth line comprising (2N+1) one-quarter-wavelength lines, connected between the transmission lines associated with said third and fourth input/output terminals;

wherein a characteristic impedance of each of said first and second lines is lower than a characteristic impedance of each of said transmission lines respectively connected to said first, second, third and fourth input/output terminals, and wherein characteristic impedances of adjacent one-quarter-wavelength lines of said cascaded (2N+1) one-quarter-wavelength lines comprising said third line are different from each other, and wherein characteristic impedances of adjacent one-quarter-wavelength lines of said cascaded (2N+1) one-quarter-wavelength lines comprising said fourth line are different from each other.

2. A directional coupler of claim 1, wherein said characteristic impedance of said first and second lines are equal to each other, and said cascaded (2N+1) one-quarter-wavelength lines comprising each of said third and fourth lines are composed of alternately disposed one-quarter-wavelength lines of a high characteristic impedance and one-quarter-wavelength lines of a low characteristic impedance.

3. A directional coupler of claim 2, wherein said first input/output terminal is an input terminal, and said third input/output terminal is an output terminal, and said second input/output terminal is terminated with a dummy resistor, and said fourth input/output terminal is connected to a detector composed of a detecting element having one end grounded at high frequency.

4. A directional coupler of claim 3, wherein said detecting element is a diode element, and wherein said diode element and said fourth input/output terminal are connected only through a transmission line having an impedance which is equivalent to said characteristic impedance of said transmission line connected to said first or third input/output terminal.

5. A directional coupler comprising:

first, second, third and fourth input/output terminals each having transmission lines respectively connected thereto;

a first line having a line length which is a quarter wavelength, said first line being connected between the transmission lines associated with said first and third input/output terminals;

a second line having a line length which is a quarter-wavelength, said second line being connected between the transmission lines associated with said second and fourth input/output terminals;

a third line having a line length which is (2N+1)/4 wavelength wherein N is a positive integer said third line comprising a cascaded total of (2N+1) lines of one-quarter-wavelength lines and at least one quarter-wavelength coupled-line having an open-ended structure, said third line being connected between the transmission lines associated with said first and second input/output terminals, and a fourth line having a line length which is (2N+1)/4 wavelength, said fourth line comprising a cascaded total of (2N+1) lines of one-quarter-wavelength lines and at least one quarter-wavelength coupled-line having an open-ended structure, said fourth line being connected between the transmission lines associated with said third and fourth input/output terminals;

wherein a characteristic impedance of each of said first and second one-quarter-wavelength lines is lower than a characteristic impedance of each of said transmission lines connected to said first, second, third and fourth input/output terminals; and wherein characteristic impedances of adjacent one-quarter-wavelength line and quarter-wavelength coupled-lines having an open-ended structure comprising said cascaded total of (2N+1) lines of said one-quarter-wavelength lines and said at least one quarter-wavelength coupled-line having an open-ended structure comprising said third line are different from each other, and wherein characteristic impedances of adjacent on-quarter-wavelength line and quarter-wavelength coupled-lines having an open-ended structure comprising said cascaded total of (2N+1) lines of said one-quarter-wavelength lines and said at least one quarter-wavelength coupled-line having an open-ended structure comprising said fourth line are different from each other.

6. A directional coupler of claim 5, wherein said characteristic impedances of said first and second lines are equal to each other, and said cascaded (2N+1) one-quarter-wavelength lines comprising each of said third and fourth lines are composed of alternately disposed one-quarter-wavelength lines of a high characteristic impedance and one-quarter-wavelength lines of a low characteristic impedance.

7. A directional coupler of claim 6, wherein said first input/output terminal is an input terminal; and said third input/output terminal is an output terminal; and said second input/output terminal is terminated with a dummy resistor; and said fourth input/output terminal is connected to a detector composed of a detecting element having one end grounded at high frequency.

8. A directional coupler of claim 7, wherein said detecting element is a diode element, and said diode element and fourth input/output terminal are connected only through a transmission line having an impedance which is equivalent to said characteristic impedance of said transmission line connected to said first or third input/output terminal.

9. A directional coupler comprising:

first, second, third and fourth input/output terminals each having transmission lines respectively connected thereto;

a first quarter-wavelength line connected between the transmission lines associated with said first and third input/output terminals;

a second quarter-wavelength lien connected between the transmission lines associated with said second and fourth input/output terminals;

a first branch line having a line length which is three-quarter-wavelength, said first branch line comprising three one-quarter-wavelength lines, and said first branch line being connected between the transmission lines associated with said first and second input/output terminals; and a second branch line having a line length which is three-quarter wavelength, said second branch line comprising three one-quarter-wavelength lines, and said second branch line being connected between the transmission lines associated with said third and fourth input/output terminals;

wherein a characteristic impedance Z1 of each of said first and second one-quarter-wavelength lines is lower than a characteristic impedance Z0 of each of said transmission lines connected to said first, second, third and fourth input/output terminals, and wherein characteristic impedances Z2, Z3, Z2 of said three cascaded one-quarter-wavelength lines respectively comprising said first and second branch lines are selected such that characteristic impedances of adjacent one-quarter-wavelength lines are different from each other, while the characteristic impedance Z3 of said quarter-wavelength line having one-quarter-wavelength lines with characteristic impedance Z2 on either side thereof is selected to satisfy a relationship of $Z3>Z2>Z0$.

10. A directional coupler comprising:

first, second, third and fourth input/output terminals each having transmission lines respectively connected thereto;

a first quarter-wavelength line connected between the transmission lines associated with said first and third input/output terminals;

a second quarter-wavelength line connected between the transmission lines associated with said second and fourth input/output terminals;

a first branch line having a line length which is three-quarter-wavelength, said first branch line comprising a quarter-wavelength coupled-line having open-ended structure, cascaded with a quarter-wavelength line, and a quarter-wavelength coupled-line having an open-ended structure, said first branch line being connected between the transmission lines associated with said first and second input/output terminals; and a second branch line having a line length which is three-quarter-wavelength, said second branch line comprising a quarter-wavelength coupled-line having an open-ended structure, cascaded with a quarter-wavelength line, and a quarter-wavelength coupled-line having an open-ended structure, said second branch line being connected between the transmission associated with said third and fourth input/output terminals;

wherein a characteristic impedance Z1 of each of said first and second one-quarter-wavelength lines is lower than a characteristic impedance Z0 of each of said transmission lines connected to said first, second, third and fourth input/output terminals, and wherein characteristic impedances Z2, Z3, Z2 of said cascaded quarter-wavelength coupled-line having an open-ended structure, and said quarter-wavelength line, and said quarter-wavelength coupled-line having an open-ended structure comprising each of said first and second branch lines satisfy a relationship of $Z2^2/Z3 \geqq Z0$.

* * * * *